US005469968A

United States Patent [19]

Matthews et al.

[11] Patent Number: 5,469,968

[45] Date of Patent: Nov. 28, 1995

[54] PEEL-PEEL-PUSH CHILDPROOF PACKAGING STRUCTURE

[75] Inventors: Gene C. Matthews, Powhatan; Mary C. Speight, Amelia, both of Va.

[73] Assignee: Reynolds Metals Company, Richmond, Va.

[21] Appl. No.: 310,516

[22] Filed: Sep. 22, 1994

[51] Int. Cl.[6] ..... B65D 83/02

[52] U.S. Cl. ..... 206/532; 220/359; 428/138; 206/484

[58] Field of Search ..... 206/531, 532, 206/484; 220/359; 428/43, 138

[56] References Cited

U.S. PATENT DOCUMENTS

| | | | |
|---|---|---|---|
| Re. 29,705 | 7/1978 | Compere . | |
| 2,552,664 | 5/1951 | Burdine | 428/138 X |
| 3,229,785 | 1/1966 | Pottash | 428/138 X |
| 3,809,221 | 5/1974 | Compere . | |
| 3,835,995 | 9/1974 | Haines . | |
| 3,899,080 | 8/1975 | Brunda | 206/531 |
| 3,912,081 | 10/1975 | Haines et al. . | |
| 3,921,805 | 11/1975 | Compere . | |
| 3,924,746 | 12/1975 | Haines . | |
| 4,196,809 | 4/1980 | Tonrey . | |
| 4,269,032 | 5/1981 | Meginnis et al. | 428/138 X |
| 4,276,338 | 6/1981 | Ludwa et al. | 428/138 X |
| 4,280,621 | 7/1981 | Tonrey . | |
| 4,371,080 | 1/1983 | Haines . | |
| 4,667,814 | 5/1987 | Wakamatsu et al. | 220/359 X |
| 4,988,004 | 1/1991 | Intini . | |
| 5,088,603 | 2/1992 | Kirkpatrick . | |
| 5,172,812 | 12/1992 | Wharton et al. . | |
| 5,197,618 | 3/1993 | Goth | 220/359 X |
| 5,235,149 | 8/1993 | Boehrer | 220/359 X |

FOREIGN PATENT DOCUMENTS

| | | | |
|---|---|---|---|
| 2411578 | 9/1975 | Germany | 206/531 |

*Primary Examiner*—Bryon P. Gehman
*Attorney, Agent, or Firm*—Alan T. McDonald

[57] ABSTRACT

A childproof covering of a blister pack, e.g., one used to contain and vend tablets of medication, is heat-sealed to an element containing recesses for containing the tablets. The heat sealing disposes a frangible foil over the tablets, and provides two successive peelably adhered layers, preferably of a transparent plastic material, thereover. These two layers are each provided with a series of perforations in respective different patterns. Such a structure prevents a young child from biting through to the medication yet enables an older child or adult to successively peel away portions of the two plastic films to, thereafter, apply a force to the medication to rupture the foil in known manner. The adhesive layers by which the two plastic films are adhered to the frangible foil may include an ingredient which is harmless but will taste unpleasant to a young child and discourage further efforts to access the medication.

22 Claims, 2 Drawing Sheets

PEEL-PEEL-PUSH CHILDPROOF PACKAGING STRUCTURE

TECHNICAL FIELD OF THE INVENTION

This invention relates to childproof packaging of medications and the like, and more particularly to structure intended to frustrate rather than seek to make impossible or overpower a young child's attempts to open a package while permitting older children and adults to readily access the package contents.

BACKGROUND OF THE RELATED ART

Blister packs, typically formed of thin-walled clear molded plastic material for holding individual tablets, caplets or capsules, backed by a forcibly-tearable foil backing sheet, are well-known and in wide commercial use. The user of such an at least partially transparent blister pack can readily see the contents, e.g., items of medication, in each of several defined and individually sealed cavities therein. By applying force from the front to the foil behind a chosen cavity the user can cause a tear in the foil to thereby extract the contents of just that cavity. The other cavities remain sealed and retain their contents for similar access as needed in the future. Numerous cold and allergy remedies, headache and pain pills, and the like, are routinely stored, vended and dispensed in such packaging structures.

In another related context, manufacturers of drugs and pharmaceutical products often form small blister packs and provide them to medical practitioners as "samples" of newly developed medications. It is not unusual for one who visits a doctor with a complaint to be provided with one or more such sample blister packs by a doctor who is persuaded that the medication contained therein will be beneficial to the patient.

In yet another related use, businesses such as hotels and airlines also often maintain supplies of small blister packs in which correspondingly small quantities of medications are made readily available without charge to their customers or passengers.

Under all of the above-cited circumstances of normal use, there is always the danger that through neglect or inattention by an adult the blister pack will fall into the hands of a young child, e.g., one less than about four years old. For present purposes such a "young child" is one who has not learned and therefore cannot be expected to appreciate the danger in playing with or ingesting attractive but potentially harmful tablets, caplets, capsules or the like. Manufacturers of such products therefore have a serious interest in developing blister pack packaging which provides the advantages of rendering the contents of individual cavities or storage compartments visible, retains them in well-sealed condition pending use, allows responsible persons to access the contents of individual compartments readily, and yet resists efforts by a young child to access the contents of the individual compartments by chewing on, tearing up, or otherwise rupturing such a blister pack of any size.

One obvious way to make such a package childproof is to make the foil relatively thick and strong enough to resist tearing by a young child's teeth. Unfortunately, this will also defeat the purpose of allowing a responsible older child or adult to tear the foil to readily access the package contents. One known solution is to provide an additional peelable layer, e.g., of a film made of a plastic material adhered to the outside surface of the foil in what is sometimes called "peel-push" backing. Perforations may be provided in the added layer to facilitate its removal and one or more corner or edge portions thereof may be left unadhered to the underlying foil in an unobvious manner. A responsible person, but not a young child, may then easily peel and tear off part or all of the added-on protective layer to reach and tear the foil. Peelable adhesive materials for such applications are well known.

Surprisingly, although many adults display embarrassingly short attention spans, young children may often spend many minutes chewing on, banging on, or otherwise roughly handling small objects. When such a small object is a blister pack containing medications which the child should not play with or ingest, a few minutes of persistent chewing or gnawing on the conventional single foil or "peel-push" combination of a protective layer and foil may prove sufficient to allow the child the undesired access to the contents of the blister pack. In other words, when the basic concept is to simply "overpower" a young child solely by the strength of the package backing, the child's natural persistence may ultimately defeat such conventional protection and could lead to serious if not tragic results. It is therefore considered preferable to employ approaches which seek to outmaneuver or distract the young child away from efforts to open the package.

As more and more relatively powerful drugs become available and are vended in blister packs, or distributed as samples, the danger from improper ingestion of such materials by young children constantly increases. There is, therefore, a felt need for a blister pack structure which allows ready access by responsible individuals yet manages to outmaneuver, frustrate and/or quickly cause lack of interest in a very young child who handles a blister pack containing materials potentially harmful. The present invention addresses this need.

SUMMARY OF THE INVENTION

Accordingly, it is a principal object of this invention to provide a simple structure for a childproof blister pack for sealingly storing and readily making available elements of medication such as tablets, caplets, or capsules, to an older child or adult while defeating efforts by a young child to do the same.

Another object of this invention is to provide a blister pack structure for containing elements of medication in at least one sealed compartment in such a manner that an older child of responsible adult may easily access the medication but which, for safety, frustrates and bores a small child who attempts to do the same.

Yet another object of this invention is to provide an improvement for the conventional blister pack structure for vending potentially dangerous medication, e.g., tablets, caplets or capsules, in such a manner that while older children and adults can reach the medication quickly, a young child will not be able to do so and will in fact be positively discouraged from efforts to open the blister pack and access its contents.

A related important object of this invention is to provide a multilayer covering which can be applied to a container, e.g., a blister pack element having cavities to contain items of medication, which can readily be applied in conventional manner and which provides childproof but readily adult-accessible containment.

Yet another related object of this invention is to provide a method for sealing, in a known blister pack packing modality, medications or the like in such a manner that while older children and adults can readily access the sealed-in items a young child attempting to do the same will be frustrated and bored in such a potentially harmful attempt.

These and other related objects of this invention are realized by providing a childproof package which includes a containment element with a flange portion and a recessed portion which is shaped and sized to accommodate an item therein. A multilayer covering is attached to the flange portion so as to surround the recessed portion to sealingly retain the item therein. The multilayer covering, as considered in sequence from the flange portion, comprises a first adhesive layer, a frangible first film which can be forcibly ruptured by the user, a second adhesive layer and a film adhered thereto and containing a plurality of perforations in a first pattern. To the second film is applied a third adhesive layer and a third film which contains a plurality of perforations in a second pattern. A young child attempting to bite into or otherwise open such a package will have to contend with three sequentially adhered films which resist penetration by biting and, because of the different perforation patterns will frustrate the child's attempts to tear into the package with his or her fingers.

In another aspect of the invention, at least one of the second and third adhesive layers contains a material which while harmless to humans would taste unpleasant, particularly to a child. The goal is to discourage or frustrate the child, rather than to overpower it simply by interposing a tough film which might also be difficult for an older child or adult to remove.

In yet another aspect of this invention is provided a multilayer covering which includes two cooperating films adhered to each other with each having pluralities of perforations in distinctive patterns and adhered thereto an imperforate third film with a third layer of adhesive applied thereto and having an exposed surface for adhering thereat to a surface surrounding an opening of a container to cover the same.

In yet another aspect of this invention there is provided a method for sealing a container for an item such as a medication in such a manner that a young child would be frustrated in efforts to access the item but older children and adults may readily remove two peelable and differently perforated layers to thereafter rupture a frangible foil of conventional type in known manner.

These and other related aspects of this invention are described below in greater detail, with reference to the accompanying drawing figures.

DETAILED DESCRIPTION OF THE PREFERRED EMBODIMENTS

Figure 1:
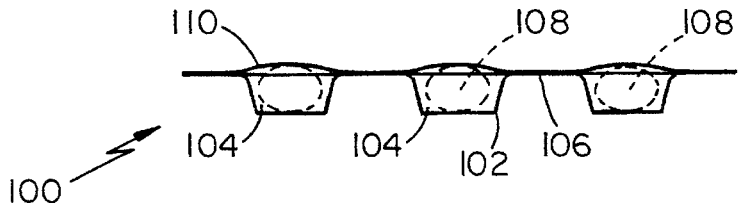
Figure 1 (PRIOR ART)
FIG. 1 is an end elevation view of a conventional blister pack structure of the type used to store and vend tablets, capsules, or caplets of medication.

As best seen in the end elevation view per FIG. 1, the conventional blister pack 100, of the type often used to contain individually sealed items of medication, e.g., tablets, has a substantially transparent lower element 102 formed to have a plurality of spaced-apart recesses 104, 104 separated by a generally planar flange portion 106. The recesses 104, 104 are generally shaped and sized to closely receive therein the individual elements of medication, e.g., tablets 108, 108. To retain the tablets in their respective recesses, to an upper surface of the flange portion 106 is adhered a flexible covering 110, portions whereof may be removed over individual recesses to access the tablets stored therein. Capsules or caplets are among the other forms that the medication may take. Items other than medication may also be packaged as generally described below.

In some countries, e.g., in Europe, to avoid rattling of the elements of medication within the recesses it is customary to shape and size recesses 104 and to apply the covering 110 in such a manner that the elements 108 of medication are somewhat forcibly held in place. Where the medication is in the form of relatively soft and frangible tablets or the like, it may instead be desirable to make the recesses 104 somewhat larger so that the tablet is not accidently crushed in day-to-day handling of the blister pack at the point of sale (or subsequent to its purchase by a user).

Figure 2:
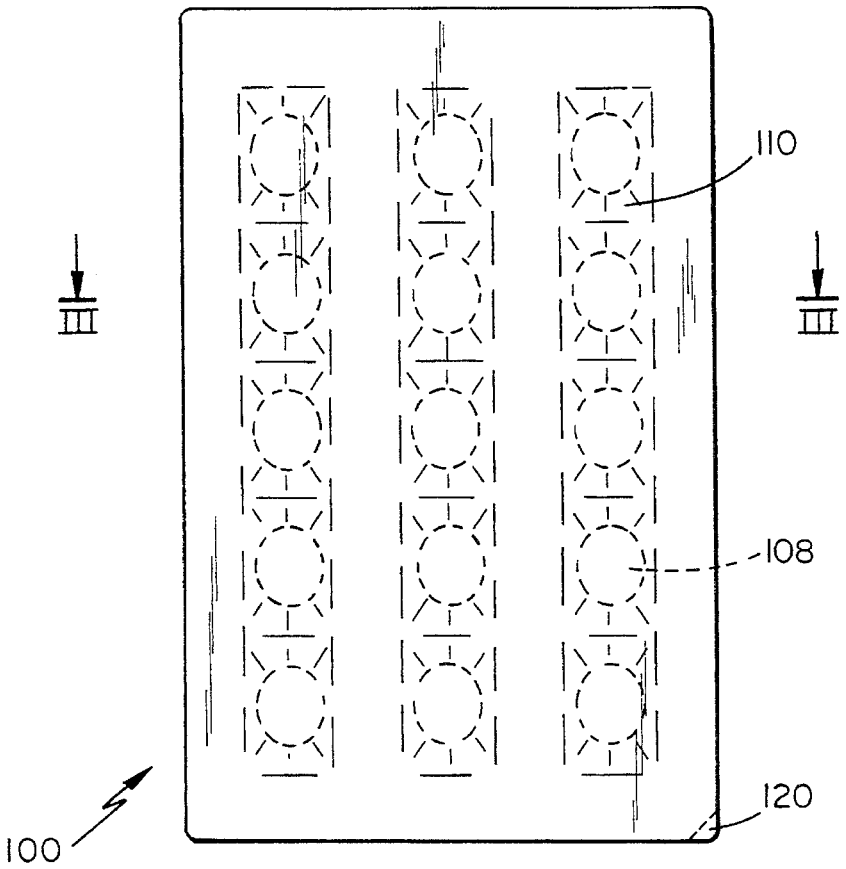
Figure 2 (PRIOR ART)
FIG. 2 is a plan view of an exemplary blister pack structure according to FIG. 1.

The conventional blister pack per FIG. 1 is seen in plan view in FIG. 2, looking at the covering 110 which is seen to be somewhat stretched and pressing onto a plurality of tablets 108, 108 stored therebelow. Persons of ordinary skill in the art will appreciate from FIG. 2 that in a conventional blister pack of this type a small corner portion 120 of the covering 110 may be left unadhered to the top surface of flange 106 to facilitate easy peeling off of the covering 110 from the lower element 102 thereat.

Figure 3:
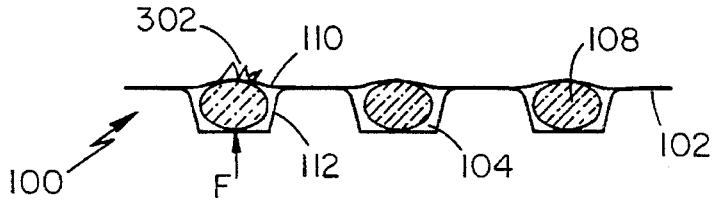
Figure 3 (PRIOR ART)
FIG. 3 is a transverse cross-sectional view at Section III—III in FIG. 2.

FIG. 3 is a transverse cross-sectional view at III—III in FIG. 2. The recessed element 102 is typically made of a transparent plastics material, and the contents 108 may be readily viewed through the bottom or side walls 112 of the recesses 104. As will be readily understood, if covering 110 consisted solely of a thin frangible film, e.g., a thin aluminum foil, it will effectively seal out ambient dust and contaminants from the medication and could be adhered to element 102 with any of a large number of suitable heat-sealing adhesives. Then, when a user wants one of the tablets 108, 108 he or she must apply a force to the base of the corresponding recess 104 and thereby use the tablet body itself to rupture through the foil covering 110 and then extract the tablet. The other tablets would still remain sealed in their respective recesses. Such an extraction act is schematically illustrated in FIG. 3 as involving the rupture at 302 of covering 110 in response to an applied force "F" as indicated by an arrow.

Most medication tablets tend to be brightly colored, and young children have a tendency to put small colorful things into their mouths when given the opportunity. There is therefore a serious risk that if a young child gets hold of a blister pack he or she will attempt to bite through the soft foil in an effort to extract the tablet. If successful, the child will likely ingest the tablet. Since some medications are very potent and should not be taken casually, this problem has been addressed with varying degrees of success in the known art. Details of one such known solution are illustrated schematically in sectional view in FIG. 4.

Figure 4:
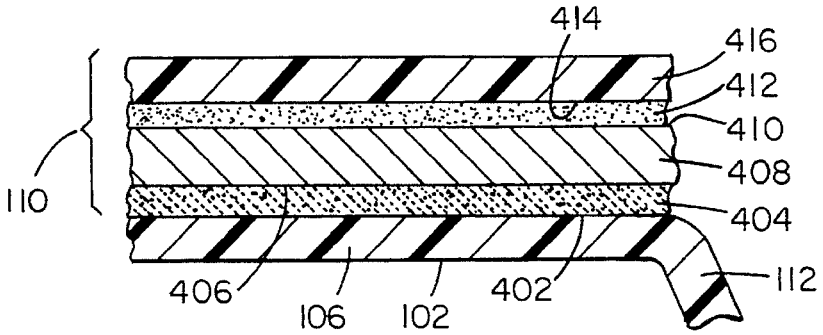
Figure 4 (PRIOR ART)
FIG. 4 is a cross-sectional view of a multilayer covering structure of a "peel-push" type commonly used for sealing items of medication into blister packs.

In the known childproof blister pack covering-structure per FIG. 4, at the bottom portion is illustrated a fragment of a generally transparent plastic lower element 102 which has a flange portion 106 and a recess sidewall portion 112. At an upper surface 402 of flange 106 there is typically applied a pressure-responsive and heat-actuated adhesive layer 404 by which a lower surface 406 of a frangible metal foil 408 is adhered to flange 106. To an upper surface 410 of foil 408 is applied a layer of peelable adhesive 412 to which is adhered a lower surface 414 of a relatively tough, bite-resistant, generally transparent film 416 made of a plastic material. The goal, thus, is to interpose the tough, bite-resistant film 416 between the child's teeth and the relatively fragile foil 408. An older child or adult can read instructions provided on or with the blister pack and, in any conventional manner, tear off a portion or all of the bite-resistant film 416 to thereafter forcibly remove the contents of a particular recess by tearing the foil thereover.

The problem, as noted earlier, is that young children tend to be rather persistent in their efforts to access small objects which they find attractive. Furthermore, even if a young child did not succeed in entirely tearing away the bite-resistant film 416, the presence of such a single film limits its ability to entirely prevent all punctures through which the child's saliva could enter the recess and dissolve some of the medication therein, whereby the dissolved medication could leak out and be ingested by the child. Furthermore, when the bite-resistant film 416 is deliberately provided with apertures, cuts or other structural features to facilitate tearing-off of portions thereof by an older child or adult, there will likely be weaknesses in the structural integrity of the bite-resistant film 416 over one or more recesses containing medication.

The success of the prior art solution as illustrated in FIG. 4 must therefore depend largely on the physical strength of the bite-resistant film 416, since foil 408 cannot be depended upon to seriously resist the biting action of a young child's sharp teeth. There are two ways in which such a bite-resistant film can be made sufficiently strong: by making it relatively thick, or by keeping the thickness relatively small but by selecting a particularly tough material. Both options have been tried in various commercially-available blister packs. Making the film relatively thick tends to add to the weight of the package and to its cost, and makes it difficult even for adults to tear through perforations provided therein as discussed above. On the other hand, keeping the film thickness small but using particularly tough materials does not generally make the problem any easier if the selected material is to be tough enough to resist the strong biting action of sharp young teeth.

Figure 5:
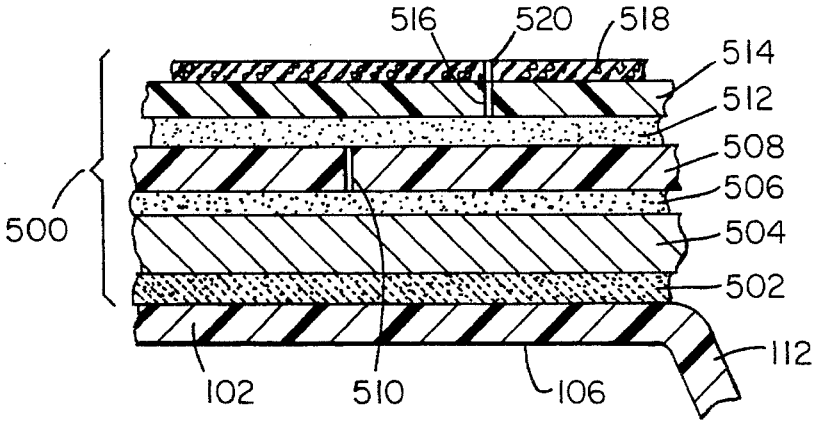
FIG. 5 is a cross-sectional view of the childproof sealing structure according to a preferred embodiment of the present invention, having a "peel-peel-push" architecture.

The present invention is best understood with reference to the transverse cross-sectional view per FIG. 5. In the structure according to this preferred embodiment, a conventional transparent plastic containment element 102 of a conventionally shaped blister pack has a flange portion 106 and a recess defined in part by a recess sidewall portion 112. The multilayer covering 500 according to the preferred embodiment, however, differs in various respects from the known covering 110 which was discussed above with reference to FIG. 4.

Figure 6:
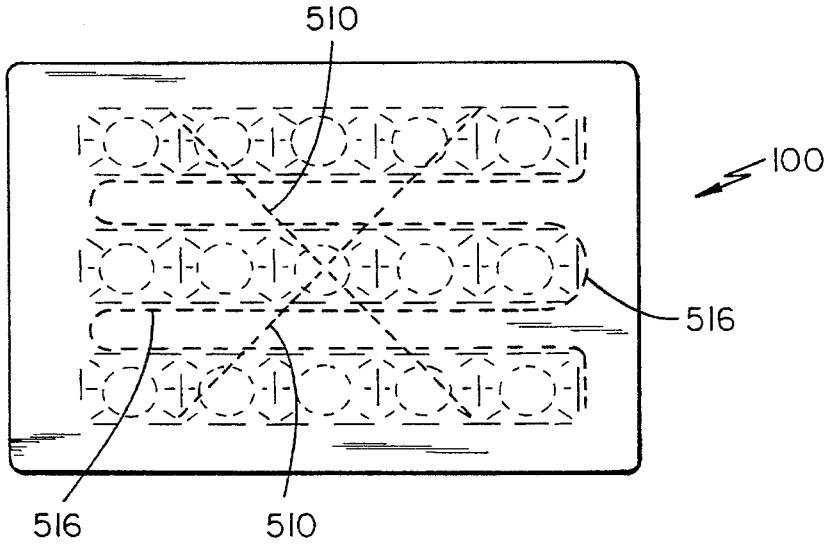
FIG. 6 is a plan view of a blister pack according to the preferred embodiment of this invention, particularly illustrating exemplary patterns of plural perforations provided in two peelable childproof films in the structure according to the preferred embodiment.

In the multilayer covering 500 according to this invention, there is provided a first adhesive layer 502 which preferably comprises a pressure-applied and heat-actuable adhesive material of known type. To this first adhesive layer 502 is adhered a frangible first film 504, preferably made of aluminum foil which can be ruptured in known manner by applying a force to the solid tablet by pressing on a bottom of the corresponding recess. To an upper surface of frangible film 504 is applied a layer 506 of a peelable adhesive material, i.e., one which seals out contaminants and retains its adherence over the shelf life of the blister pack. With the application of reasonable effort it can be forced to release or peel-off from surfaces adhered thereto. To an upper surface of this layer of peelable adhesive material 506 is applied a child-resistant film 508 into which are formed a plurality of through perforations 510. These are spaced apart and sized so as to facilitate tearing-off of portions of the film 508 by a user intending to do so. Reference to FIG. 6 indicates a preferred exemplary disposition of these perforations 510, namely in the form of two intersecting lines which extend over one or more of the recesses of the blister pack.

To an upper surface of the child-resistant film 508 is applied a second layer of peelable adhesive material 512 which may but need not necessarily have the same chemical composition and/or thickness as the underlying peelable adhesive layer 506. Then, to an upper surface of peelable adhesive layer 512 is adhered a second child-resistant film 514 which has its own plurality of through perforations 516 which have a different distribution and disposition, as best understood with reference to FIG. 6.

It should be understood clearly that what is important is that the dispositions of through apertures 510 and 516 be different. The plurality of apertures 516 in the outermost child-resistant film 514 preferably run along and over flange 106 of the underlying recessed element and not over any recesses defined therein. By contrast, as discussed above, the plurality of apertures 510 is formed so that at least some of those apertures are located directly above one or more recesses.

Although the above-described distributions of through apertures 510 (in child-resistant film 508) and 516 (in child-resistant film 514) are only exemplary and should not be considered limiting, certain interrelationships between them are highly desirable. Thus, apertures 516 should be disposed in such a manner that an older child or adult can, simply by forcibly bending the flange portion near one end of the blister pack, cause a physical break in the child-resistant film 514 and peel off a portion thereof to then expose the underlying first child-resistant film 508. Note that since apertures 516 do not overlie any of the recesses, even if a young child managed to peel off a portion of child-resistant film 514 in this manner the child would not have immediate access to the contents of any of the underlying recesses. The child, in fact, would then have to deliberately seek out and apply force to apertures 510 in the underlying child-resistant film 508. Although this may be possible, as explained below, additional measures can be incorporated into the structure 500 to discourage and frustrate the child from attempting further access to the medication.

In addition, it should be noted that through apertures 510 of child-resistant film 508 are sealed at their opposite ends by peelable adhesive layers 506 and 512. Similarly, through apertures 516 in second child-resistant film 512 are sealed by the sealable adhesive layer 512. Thus, although there may be numerous such apertures 510 and 516, they do not enable ingress of any external contaminants into any significant portion of the thickness of covering 500 when considered as a multilayer covering.

On the outermost surface of second child-resistant film 514 there may be adhered an additional layer 518 of paper or felt material upon which useful information may be stamped, printed or handwritten as appropriate. Thus, a doctor or pharmacist providing such a medication to a patient could note the patient's name and/or dosage schedule, or the manufacturer of the medication may provide useful information on its ingredients by printing on layer 518. A plurality of apertures 520, preferably congruent with through apertures 516, should be provided in such an optional layer 518 if one is included in the overall structure. This would enable a grown child or adult to simultaneously tear off the layers 514 and 518 at the congruent through apertures 516 and 520, respectively, formed therein.

It should be appreciated that a "peelable" adhesive layer, e.g., 506 or 512, while permitting a user to intentionally peel-off a portion of the layer will also allow the same layer to be re-adhered if the adhesive material retains its stickiness. The child-resistant layers 508 and 514 are preferably made of transparent, flexible but tough material. Many such materials are commercially available. In addition, it may be preferable to include in the peelable adhesive materials 506 and 512 coloring ingredients which color them differently. Then, for example if peelable adhesive material 506 were yellow and peelable adhesive material were blue, where both of them are present a person would see the combined results as a generally green color. However, if one or the other were removed then the color visible would be either yellow or blue instead of green. By such a provision it becomes possible at a mere glance to determine whether one or the other layer of child-resistant material has been removed or otherwise tampered-with.

If a determined young child bites through child-resistant layer 514, he or she will reach peelable adhesive layer 512. To discourage the child from biting further, it may be helpful to include in peelable adhesive 512 an ingredient which is harmless to human beings but which tastes unpleasant, e.g., quinine (which tastes bitter) or an extract of pepper (which would cause a pungent or burning sensation). A child tasting such a material probably would be discouraged from biting further. Such a material could also be included in peelable adhesive layer 506 for additional comparable benefit. In summary, the structure of multilayer covering 500, as illustrated in FIGS. 5 and 6, includes not only a conventional layer of foil 504 conventionally heat sealed to the medication layer element 102, but in addition, includes two successive peelable layers of child-resistant film each having its own series of through apertures in different distributions, with options including unpleasant tasting ingredients in one or both of the peelable adhesive layers, as well as an outermost layer 518 which lends itself to carrying useful readable information.

One or both of the child-resistant films 508 and 514 may be made of 60 gauge or 1 mil nylon film, or may be a polyester film.

Other suitable materials are polypropylene and cellophane, and typical thicknesses for these may range from 0.00025 in. to 0.001 in.

Suitable peelable adhesive layers are known in pressure-sensitivity adhesive technology, and may include compositions comprising vinyl, acrylic, or urethane based materials.

Peelable adhesive layers 506 and 512 need not be applied as continuous layers but may, to facilitate peeling of the adhered film as intended, may be applied in patterns in any known manner.

In addition to quinine and pepper, other generally harmless but unpleasant tasting materials for inclusion into the peelable adhesive layers are mustard oil and pine oil. Persons of ordinary skill in the art will no doubt consider other materials capable of performing the desired functions.

Although the above discussion has been focused on an overall structure of a blister pack made child resistant by the provision of covering 500, it should be appreciated that the invention comprehends both the covering structure 500 by itself as well as in conjunction with a recess and flange-type lower element adhered thereto. Thus, for a variety of container elements with openings having a surface around the opening, the present invention provides a covering structure including a first layer of heat-actuable adhesive 502, a first film 504, a first peelable adhesive layer 506, a first child-resistant film 508 adhered thereby, a second peelable adhesive material layer 512, a second child-resistant film 514 adhered thereby, and an optional outermost layer 518 capable of bearing readable information. In such a structure, the child-resistant films (or layers) 508 and 514 will be provided with their respective pluralities of through apertures 510 and 516. If the optional layer 518 is included in the structure, it is conveniently provided with a plurality of through apertures 520 in congruence with through apertures 516. Such a structure could be manufactured as a large multilayer sheet, and by conventional pressure/heat technology could be adhered to flange portions of a lower element containing recesses within which items of medication may be placed.

Similarly, it should be understood that the present invention comprehends a method for rendering blister pack type structure child-resistant, by applying thereto a layer of heat-actuable adhesive 502, a frangible layer 504 (e.g., a metal foil), applying thereto a first layer of peelable adhesive 506, and adhering thereto a first child-resistant layer 508 with a plurality of through apertures 510 formed therein in a known distribution. A second layer of peelable adhesive 512 would be applied to layer or film 508 and, adhered thereto would be a second child-resistant layer 514 with its own set of through apertures 516. An optional layer 518 may be provided as an outermost layer to hold readable information and, if so, it would be provided with a plurality of apertures 520 disposed in congruence with apertures 516.

While the present invention has been described with reference to certain preferred embodiments, and with reference to medications, tablets and the like, it can also be used to produce child-resistant packages for suppositories, etc. Persons of ordinary skill in the art may be expected to consider obvious modifications of the various embodiments described above in detail, and such variations are intended to be comprehended within the present invention which is limited solely by the claims appended below.

What is claimed is:

1. A childproof package, comprising:

a containment element formed to have a flange portion and a recessed portion, said recessed portion being shaped and sized to accommodate an item therein; and a multilayer covering attached to the flange portion at least around the recessed portion so as to sealingly retain an item therein, said multilayer covering comprising in sequence from the flange portion:

(i) a first adhesive layer, (ii) a frangible first film.

(iii) a second adhesive layer, (iv) a second film containing a plurality of perforations in a first pattern, (V) a third adhesive layer, and (vi) a third film containing a plurality of perforations in a second pattern.

2. The childproof package according to claim 1, wherein:

said first adhesive layer comprises a heat-actuated adhesive material, and said second and third adhesive layers each comprise a respective peelable adhesive material.

3. The childproof package according to claim 2, wherein:

at least one of said second and third adhesive layers comprises a substance which is harmless to humans but tastes unpleasant.

4. The childproof package according to claim 3, wherein:

the first pattern of perforations comprises perforations that lie over the recessed portion.

5. The childproof package according to claim 4, wherein:

the second pattern of perforations comprises perforations which lie substantially over the flange portion.

6. The childproof package according to claim 1, further comprising:

an outermost layer capable of holding readable information, applied to the third film and having a plurality of perforations in congruence with the perforations of the third film.

7. The childproof package according to claim 5, further comprising:

an outermost layer capable of holding readable information, applied to the third film and having a plurality of perforations in congruence with the perforations of the third film.

8. The childproof package according to claim 1, wherein:

at least one of said second and third adhesive layers comprises a substance which is harmless to humans but tastes unpleasant.

9. The childproof package according to claim 1, wherein:

the first pattern of perforations comprises perforations that lie over the recessed portion.

10. The childproof package according to claim 1, wherein:

the containment element is formed of a substantially transparent material to enable viewing of the item contained in the recessed portion thereof;

said second and third films are each formed of a substantially transparent bite-resistant material; and said second and third adhesive layers comprise respective transparent and differently colored adhesive materials.

11. The childproof package according to claim 1, wherein:

the containment element and the second and third films are each formed of a substantially transparent material;

said second and third adhesive layers comprise substantially transparent adhesive materials having respective different colors and are divided in respective discontinuous patterns.

12. The childproof package according to claim 11, wherein:

the frangible first film is a metal foil.

13. A multilayer covering for a container that has a surface surrounding an opening, comprising:

a first film containing a plurality of perforations in a first pattern;

a first adhesive layer, applied to a first surface of the first film;

a second film containing a plurality of perforations in a second pattern and having a first surface adhered to the first adhesive layer;

a second adhesive layer, applied to a second surface of the second film;

an imperforate third film, having a first surface adhered to the second adhesive layer; and a third adhesive layer, applied to a second surface of the third film and having an exposed surface for adhering thereat to the surface surrounding the opening to cover the opening.

14. The multilayer covering according to claim 13, wherein:

the first and second patterns of perforations differ from each other.

15. The multilayer covering according to claim 13, wherein:

the first and second adhesive layers each comprise a respective peelable adhesive material.

16. The multilayer covering according to claim 15, wherein:

the first and second adhesive layers are each substantially transparent and of respectively different colors.

17. The multilayer covering according to claim 13, wherein:

the first and second adhesive layers are provided in respective discontinuous patterns.

18. The multilayer covering according to claim 13, wherein:

at least one of the first and second adhesive layers comprises a material which is harmless but tastes unpleasant.

19. The multilayer covering according to claim 13, wherein:

the imperforate third film is a metal foil; and the third adhesive layer comprises a heat-actuable adhesive material.

20. A method of retaining an item in a container in a childproof manner, comprising the steps of:

providing a container having a flange portion surrounding a recess for containing an item of medication;

heat sealing to the flange portion a frangible metal foil;

peelably adhering to the metal foil a first childproof film of plastic material provided with a plurality of perforations in a first pattern; and peelably adhering to the first childproof film a second childproof film of plastic material provided with a plurality of apertures in a second pattern, whereby a young child attempting to bite into the multilayer covering will be frustrated by its physical resistance to biting, whereas older children and adults are enabled to remove the childproof films sequentially at physical weaknesses generated by the perforations and apertures.

21. The method according to claim 20, comprising the further step of:

including in at least one of a first adhesive between the foil and the first childproof film and a second adhesive between the first and second childproof layers an ingredient which while harmless to humans would taste unpleasant to a child attempting to bite through the multilayer covering.

22. The method according to claim 21, wherein:

the first and second childproof films are substantially transparent and;

the first and second adhesive layers are also both substantially transparent but have respectively different colors.

* * * * *